US006022103A

United States Patent [19]

Yamaguchi

[11] Patent Number: 6,022,103

[45] **Date of Patent: *Feb. 8, 2000**

[54] METHOD FOR POSITIONING AN INK CARTRIDGE, AND THE INK CARTRIDGE AND INK JET RECORDING APPARATUS USED FOR SUCH METHOD

[75] Inventor: Sanko Yamaguchi, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/596,559

[22] Filed: Feb. 5, 1996

[30] Foreign Application Priority Data

Feb. 7, 1995 [JP] Japan ..... 7-019011

[51] Int. Cl.[7] ..... B41J 2/175

[52] U.S. Cl. ..... 347/86; 347/49

[58] Field of Search ..... 347/84, 85, 86, 347/87, 49; 222/325, DIG. 1; 141/364–366

[56] References Cited

U.S. PATENT DOCUMENTS

| | | | |
|---|---|---|---|
| 5,448,274 | 9/1995 | Hirabayashi et al. | 347/86 |
| 5,619,239 | 4/1997 | Kotaki et al. | 347/86 |

FOREIGN PATENT DOCUMENTS

| | | | |
|---|---|---|---|
| 0408241 | 1/1991 | European Pat. Off. . | |
| 0496642 | 7/1992 | European Pat. Off. . | |
| 0519457 | 12/1992 | European Pat. Off. . | |
| 0604940 | 7/1994 | European Pat. Off. . | |
| 59-12855 | 1/1984 | Japan | B41J 3/04 |
| 63-15752 | 1/1988 | Japan | B41J 3/04 |
| 1-141750 | 6/1989 | Japan | 347/86 |
| 3-184873 | 8/1991 | Japan | 347/49 |
| 5-338191 | 12/1993 | Japan | 347/86 |
| 6-15835 | 1/1994 | Japan | 347/86 |

*Primary Examiner*—John Barlow
*Assistant Examiner*—Judy Nguyen
*Attorney, Agent, or Firm*—Fitzpatrick, Cella, Harper & Scinto

[57] ABSTRACT

A method for positioning a cartridge by allowing the fitting portion of the ink cartridge to engage with the ink supply tube supporting portion of the ink cartridge housing when the ink cartridge is mounted on the ink cartridge housing includes the steps of positioning the ink supply tube and the ink cartridge fitting portion by guiding the ink cartridge by means of the engagement between the ink cartridge housing member and the ink cartridge until the fitting portion of the ink cartridge and the supporting portion of the ink supply tube begin to engage with each other; and completing the mounting of the ink cartridge on the ink cartridge housing member by loosening at least partly the engagement between the ink cartridge housing member and the ink cartridge after the engagement is made between the fitting portion of the ink cartridge and the supporting portion of the ink supply tube. With such structure, the operativity of the method is enhanced, while positioning the supply tube and the fitting portion of the ink cartridge in high precision. Further, no load is given to the supply tube and the supply tube supporting portion after the completion of its engagement.

18 Claims, 7 Drawing Sheets

METHOD FOR POSITIONING AN INK CARTRIDGE, AND THE INK CARTRIDGE AND INK JET RECORDING APPARATUS USED FOR SUCH METHOD

BACKGROUND OF THE INVENTION

1. Field of the Invention

The present invention relates to a method for positioning an ink cartridge when the ink cartridge is mounted on an ink jet recording apparatus, and the ink cartridge and ink jet recording apparatus used for such method.

2. Related Background Art

Regarding the structures whereby to position a detachably mountable ink cartridge in a given position for an ink jet recording apparatus, there have been known the ones such as disclosed in Japanese Patent Laid-Open Application No. 63-15752 and Japanese Patent Laid-Open Application No. 59-12855.

FIG. 6 is a view which schematically shows a structure for positioning an ink cartridge according to the prior art disclosed in the Japanese Patent Laid-Open Application No. 63-15752. FIG. 7 is a view which schematically shows a structure for positioning an ink cartridge according to the prior art disclosed in the Japanese Patent Laid-Open Application No. 59-12855.

The structure for positioning the ink cartridge shown in FIG. 6 is arranged to supply ink from each ink supply port 65 of the cartridge case 63 through the plug of each ink cartridge 61. Here, the positioning pin 62 provided for each ink cartridge 61 is inserted along each positioning groove 64 arranged for the cartridge case 63. Then, in positioning the needles 66 of the cartridge case 63 at the plug of the ink cartridge 61, the needle 66 is made to penetrate through into the plug.

The structure for positioning the ink cartridge shown in FIG. 7 is arranged so as to allow the ink cartridge 71 to be inserted for fitting it over a supply tube 73 to supply ink into an ink tank 72, thus positioning the ink cartridge 71 and also, preventing ink leakage from the ink cartridge 71.

However, the following problems are encountered in positioning the ink cartridge according to the prior art.

The pointed end of the needle that conducts ink from the ink cartridge into an ink jet head is sharp and dangerous according to the prior art disclosed in Japanese Patent Laid-Open Application No. 63-15752. To counteract this, it may be possible to adopt a tube like a pipe whose pointed end is not so sharp as that of the needle. In order to make it easy for such tube to penetrate the plug of the ink cartridge, a prepared hole may be provided for the plug. Even if such a countermeasure should be taken, it is not easy to make the tube penetrate the plug or, in some cases, it becomes impossible for it to penetrate the plug should there be any misregisteration between the prepared hole of the plug and the tube.

Also, for the prior art disclosed in Japanese Patent Laid-Open Application No. 59-12855, only an ink supply tube is prepared for supplying ink to an ink tank when the ink cartridge is mounted. As a result, the fitting portion arranged for mounting the ink cartridge is under the so-called shadow of the user's own hand, making it difficult to perform the required mounting operation. To counteract this, it is conceivable that a guiding portion is arranged on the periphery of the ink cartridge or the like so that the ink cartridge is guided to the fitting portion arranged for the cartridge to be mounted exactly at the end.

However, with such structure arranged as above, it is required to enhance the precision of processing dimensions of the ink cartridge considerably in addition to the provision of the guiding portion to fit the ink cartridge with the ink supply tube assuredly. Therefore, the fitting portion of the ink cartridge is rigidly restricted even after the ink cartridge and ink supply tube are positioned by fitting them together. This restriction may lead to exerting a load on the supporting portion of the ink supply tube or the like. Therefore, this arrangement is not preferable if a frequent exchange of ink cartridges should be taken into account. Meanwhile, it is possible to avoid such exertion of load as described above if the gap between the guide portion and ink cartridge is made larger, for example. This may also ease the required precision of the processing dimensions. In this case, however, the ink cartridge cannot be guided assuredly to the portion where it is fitted finally, thus making it difficult to execute any exact fitting after all. Moreover, if the posture of the ink cartridge is tilted by the hand of operator or the like when mounting it, the larger gap allows it to be inclined easily, leading to the exertion of a load to the supply tube or the supporting portion of the supply tube eventually.

SUMMARY OF THE INVENTION

The present invention is designed with a view to solving the problems of the prior art described above. It is an object of the invention to provide a method for positioning an ink cartridge while being mounted, which is capable of guiding the ink cartridge in good precision until the fitting begins between the ink cartridge and ink supply tube, but giving no load to the supply tube, the supply tube supporting portion, and the like, after the fitting is once completed, and also to provide the ink cartridge and ink jet recording apparatus used for such method.

It is another object of the invention to provide a method for positioning an ink cartridge, being capable of positioning the ink supply tube and ink cartridge in high precision by guiding a given ink cartridge housing member and the ink cartridge without any looseness in the engagement between them to the location where the ink cartridge fitting portion and ink supply tube supporting portion begin to engage with each other, and at the same time, releasing the engagement between the given housing member and ink cartridge after fitting so that the ink cartridge is not restricted by the ink supply tube supporting portion once the ink cartridge has been mounted completely on the given housing member, thus reducing the load to be exerted on the supply tube supporting portion, and also, to provide the ink cartridge and ink jet recording apparatus used for such method.

It is still another object of the invention to provide a method for positioning a cartridge by allowing the ink cartridge fitting portion to engage with the ink supply tube supporting portion of the ink cartridge housing when the ink cartridge is mounted on the housing, including the following steps of:

positioning the ink supply tube and the ink cartridge fitting portion by guiding the ink cartridge by means of the engagement between the ink cartridge housing member and the ink cartridge until the ink cartridge fitting portion and the ink supply tube supporting portion begin to engage with each other; and completing the mounting of the ink cartridge on the ink cartridge housing member by releasing at least partly the engagement between the ink cartridge housing member and the ink cartridge after the engagement is made between the ink cartridge fitting portion and the ink tube supporting portion.

DETAILED DESCRIPTION OF THE PREFERRED EMBODIMENTS

Hereinafter, with reference to the accompanying drawings, the description will be made of the embodiments in accordance with the present invention.

First Embodiment

Figure 1A:
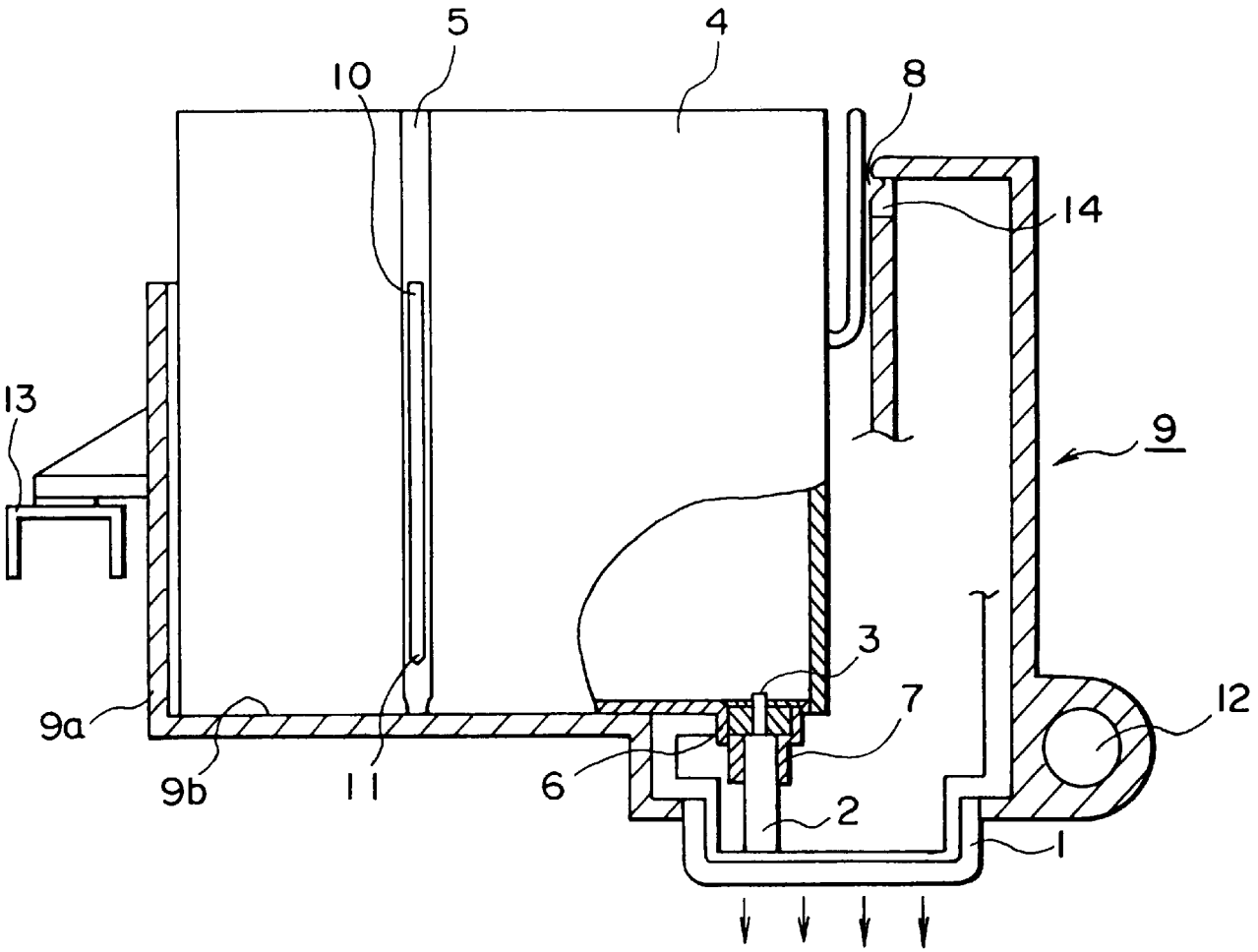
FIG. 1 is a view which schematically shows a first embodiment of the structure for positioning an ink cartridge of an ink jet recording apparatus in accordance with the present invention.
Figure 1B:
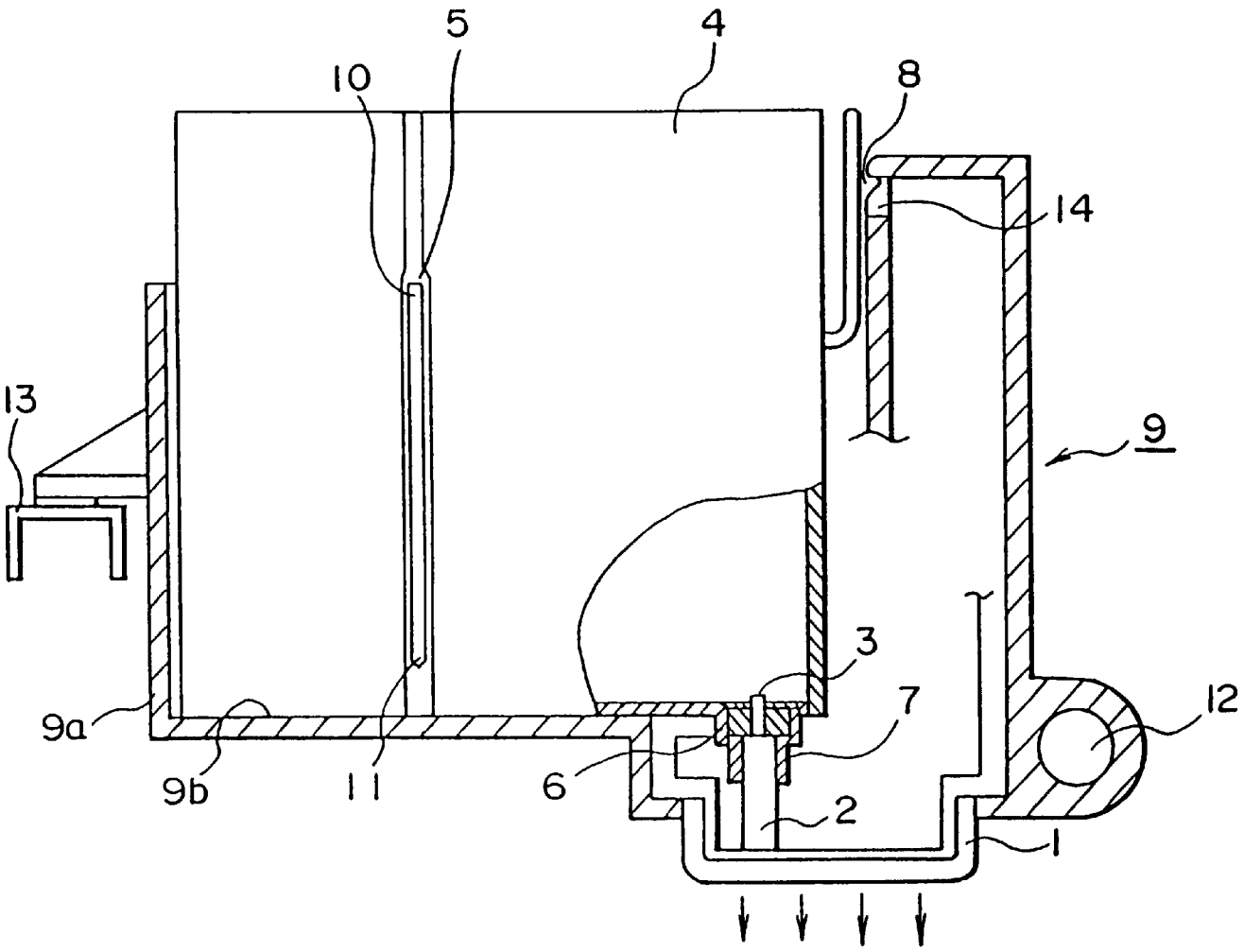

FIG. 1 is a view which schematically shows a first embodiment of the structure for positioning an ink cartridge of an ink jet recording apparatus in accordance with the present invention, and which shows the state of the ink cartridge when it is mounted.

The ink jet recording apparatus, which is provided with the structure for positioning an ink cartridge in accordance with the present embodiment, comprises a carriage 9 which causes a given housing member 9*a* having an ink jet recording head 1 being mounted on it to serially travel along the recording area as shown in FIG. 1. Here, the housing member 9*a* is a member provided with a surface 9*b* where an ink cartridge is mounted. The housing member is arranged integrally with the carriage 9, but it may be arranged separately as a member detachably mountable on the carriage 9. For the present embodiment, the description will be made of the housing member 9*a* that is formed integrally with the carriage 9. The one end of the carriage 9 is made slidable on a sliding shaft 12, and is also rotatively fitted over the sliding shaft 12. The other end of member 9*a* engages with a guide 13. Also, the carriage 9 engages with a part of a timing belt (not shown), and is arranged to reciprocate along the sliding shaft 12 when the timing belt is driven by a motor (not shown). During its reciprocation, the ink jet recording apparatus forms printed images by discharging ink from the ink jet recording head 1 in accordance with a given timing. In this respect, the ink jet recording head 1 is provided with electrothermal transducing elements (which transduce electric energy to thermal energy) or electromechanical transducing elements (which transduce electric energy to mechanical displacement) in order to generate energy for discharging ink from the ink discharge ports.

Further, the cartridge housing member 9*a* is such that an ink cartridge 4 that can retain ink in it is detachably mountable. The supply tube 3 that guides ink in the ink cartridge 4 into an ink jet recording head 1 is arranged to extrude vertically by means of the supporting portion 2 of the supply tube. Also, the supply tube 3 and the supply tube supporting portion 2 are not only in such a mode that these are fixed directly to the cartridge housing member 9*a*, but may also be in such a mode that the supply tube 3 and supply tube supporting portion 2 are installed on another member, that is, an ink jet recording head 1, for instance, and then, the ink cartridge 4 is housed by the cartridge housing member 9*a* after this ink jet recording head 1 is positioned and installed on the cartridge housing member 9*a*. It necessary that only the supply tube 3 and supply tube supporting portion 2 are located so as to allow them to engage at least with the ink cartridge 4 with respect to the cartridge housing member 9*a*.

On the side end of the ink cartridge 4, there is formed a grooved guided portion 5. On the cartridge housing member 9*a*, a guiding portion 10 is arranged with a tapered portion 11, which is tapered on the ink cartridge mounting surface 9*b* side. The guided portion 5 of the ink cartridge 4 can be inserted into the guiding portion 10. Only the groove width of the guide portion 5 on the bottom side of the ink cartridge 4 is set so that it does not present any looseness when the guided portion 5 and guiding portion 10 engage with each other. For the present embodiment, the guided portion 5 is provided on the ink cartridge 4, while the guiding portion 10 is provided on the carriage 9, but in any event it should for the guiding means that comprises a grooved guided portion and a guiding portion that can be inserted into it to be arranged relatively with respect to the ink cartridge 4 and cartridge housing member 9*a*. In other words, it may be possible to arrange the grooved guided portion on the cartridge housing member 9*a*, while the guiding portion that can be inserted into the guided portion is arranged on the ink cartridge 4. Also, the positioning is made in a higher precision if a plurality of locations are arranged for the guided and guiding portions to engage with each other.

Also, in the ink cartridge 4, an elastic plug 6 is incorporated with a prepared hole being formed for the plug by use of a needle or the like. In the interior of the ink cartridge 4, ink is retained airtightly by means of the plug 6. It may also be possible to have the ink cartridge 4 retain ink airtightly by means of the plug 6 arranged to be easily provided with a through-hole when the pointed end of the supply tube 3 is pressed against the plug. On the circumference of the plug 6, an ink cartridge fitting portion 7 is arranged to allow the supply tube supporting portion 2 to be fitted after the ink cartridge 4 has been guided along the guide portion 10.

For the ink cartridge 4, a stopper 8 is arranged to hold the ink cartridge 4 in the carriage 9, which is hooked to an aperture 14 formed on the carriage 9 for this hooking use. For the present embodiment, a plurality of ink cartridges 4 (for use of yellow, magenta, cyan, and black ink) are arranged to be mountable on the carriage 9.

Now, description will be made of the process by which the ink cartridge 4 and supply tube 3 are positioned.

Figure 2A:
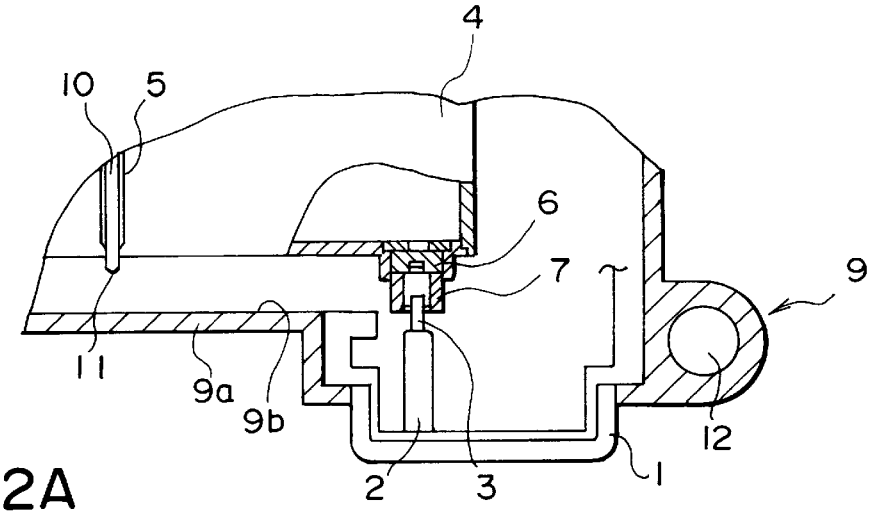
FIGS. 2A to 2C are views which illustrate the mounting process and method of an ink jet cartridge in accordance with the first embodiment of the present invention.
Figure 2B:
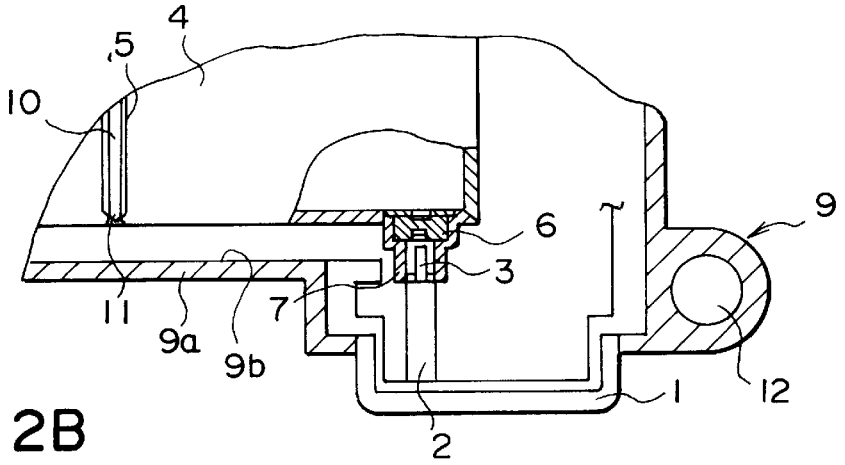
Figure 2C:
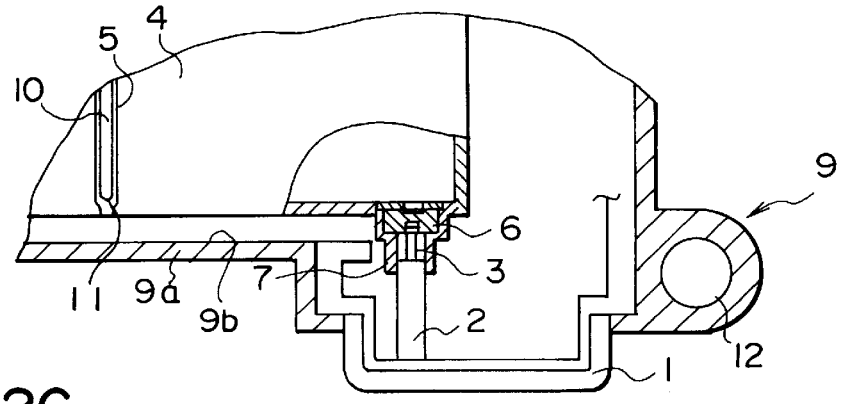

FIGS. 2A to 2C illustrate the process and method of installation of an ink cartridge in accordance with the first embodiment of the present invention.

The user inserts the guided portion 5 of the ink cartridge into the guiding portion 10 of the cartridge housing member 9*a*, and presses the ink cartridge 4 along the guiding portion 10 onto the cartridge installation surface 9*b* side of the cartridge housing member 9*a*.

Then, as shown in FIG. 2A, the supply tube 3 is in a state in which it is located in the space of the ink cartridge fitting portion 7. At this juncture, the plug 6 of the ink cartridge 4 is yet to reach the supply tube 3. The guided portion 5 is in a state in which it engages with the guiding portion 10 without any looseness.

When the ink cartridge 4 is further pressed downward in FIGS. 2A to 2C (toward the cartridge installation surface 9*b* side) from the state shown in FIG. 2A, the pointed end of the fitting portion 7 of the ink cartridge 4 reaches the pointed end of the supply tube supporting portion 2 as shown in FIG. 2B, that is, the engagement begins to be made between the ink cartridge fitting portion 7 and the supply tube supporting portion 2 in such state as described above. At this juncture, because of the tapered portion 11 is arranged at the bottom of the guiding portion 10, the guided portion 5 and guiding portion 10 tend to begin releasing the engagement between them. Also, in the state shown in FIG. 2B, the plug 6 is yet to reach the supply tube 3. (Here, however, the plug 6 may alternatively be allowed to reach the supply tube 3.)

When the ink cartridge 4 is pressed downward still farther, the ink cartridge fitting portion 7 and the supply tube supporting portion 3 are inserted by fitting as shown in FIG. 2C. In this state, the engagement between the guided portion 5 and guiding portion 10 is completely loose.

Thereafter, the plug 6 reaches the supply tube 3 when the ink cartridge 4 is completely mounted on the cartridge installation surface of the carriage. Thus the supply tube 3 penetrates the plug 6 or the prepared hole provided therein (if any ). The stopper 8 shown in FIG. 1 is hooked to the aperture 14, and the installation of the ink cartridge 4 is completed.

As described above, in the state in which the end of the ink cartridge fitting portion 7 of the ink cartridge 4 reaches the pointed end of the supply tube supporting portion 2, that is, the state where the engagement between the ink cartridge fitting portion 7 and supply tube supporting portion 2 begins, the engagement between the guide portion 5 and guiding portion 10 begins to be loose. Therefore, even after the installation of the ink cartridge 4, there is no longer any restriction imposed upon the ink cartridge 4 by the guiding portion 10.

As a result, it is possible to install the ink cartridge 4 smoothly. Also, there is no load on the supply tube supporting portion 2 after the ink cartridge 4 has been installed. Particularly, for the structure where the supply tube supporting portion 2 is installed directly on the ink jet recording head, it is possible to minimize adverse effects on the supply tube supporting portion 2 and inner liquid path of the ink jet recording head, as well as on the slanted posture of the facing plane of the ink jet recording head 1, thus obtaining clearly printed images reliably.

Also, the stopper 8 integrally formed with the ink cartridge 4 is elastic, and presses upon the portion near the aperture 14 before the stopper 8 hooks to this aperture 14 when the ink cartridge is being pressed. Therefore, its elastic force tends to act in the same lateral direction in which the ink cartridge 4 is being pressed against the guiding portion 10. Under such circumstances, there is a possibility that this force may tend to hinder the fitting and insertion of the ink cartridge fitting portion 7 and supply tube supporting portion 2 on the moment that the engagement between the guided portion 5 and guiding portion 10 is released.

Therefore, the position where the elasticity of the stopper 8 begins to act is arranged to be set in a location after the ink cartridge fitting portion 7 and the supply tube supporting portion engage with each other. In this way, it becomes possible to implement positioning more accurately, while improving its operativity.

Second Embodiment

Figure 3:
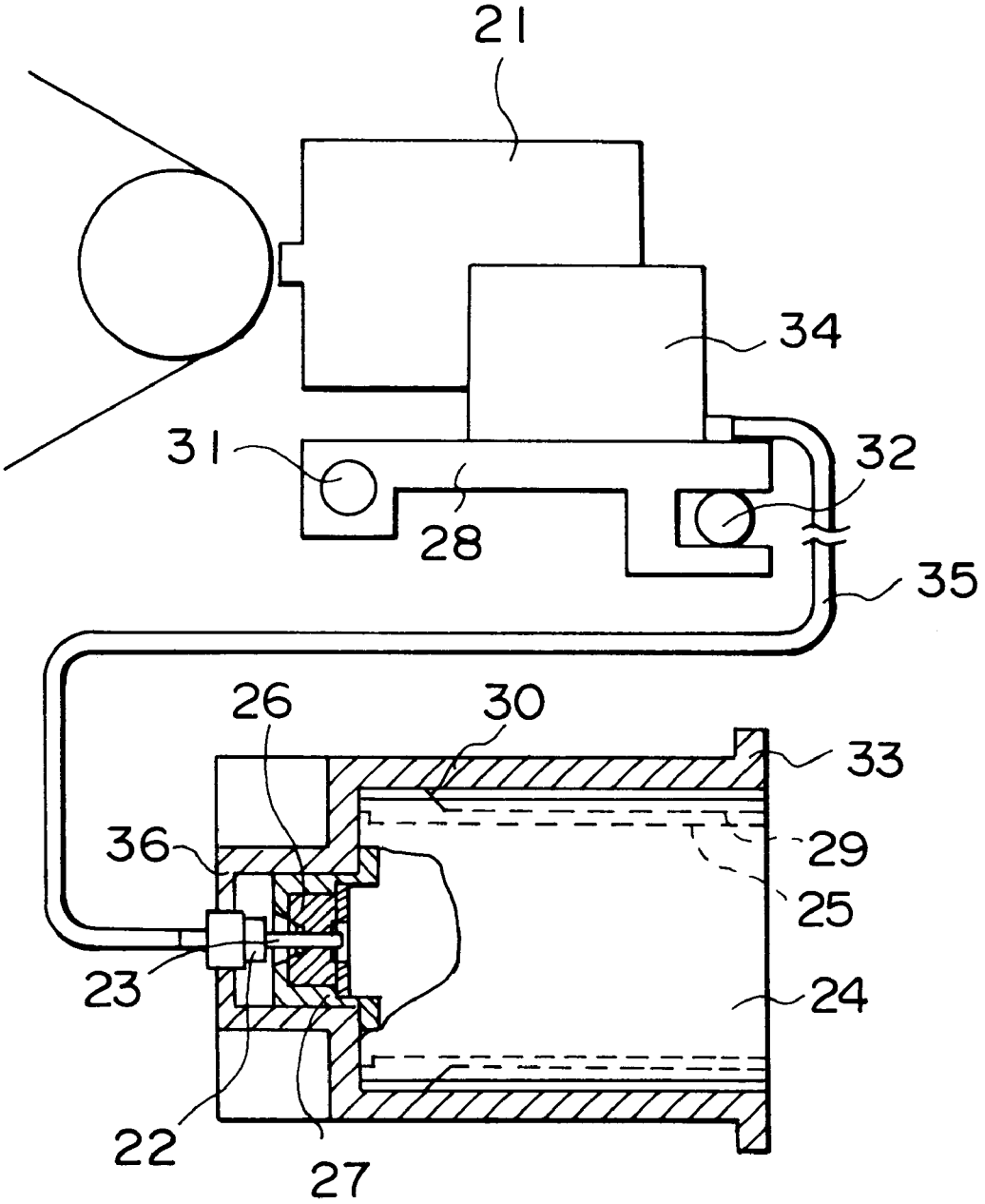
FIG. 3 is a view which schematically shows a second embodiment of the structure for positioning an ink cartridge of an ink jet recording apparatus in accordance with the present invention.

FIG. 3 is a view which schematically shows a second embodiment of the structure for positioning an ink cartridge of an ink jet recording apparatus in accordance with the present invention.

As shown in FIG. 3, the present embodiment is an example of a structure in which an ink cartridge 24 is installed in a cartridge case 33, that is, a member for housing the ink cartridge 24, and then, ink from the ink cartridge 24 is supplied to an ink tank 34 of an ink jet recording head 21 through a tube 35.

As in the first embodiment, one end of the carriage 28 is slidable on a sliding shaft 31, and is rotatively fitted over the sliding shaft 31. The other end thereof engages with a guide 32. Also, the carriage 28 partly engages with a timing belt (not shown), and can reciprocate along the sliding shaft 31 when the timing belt is driven by a motor (not shown). During this reciprocation, the ink jet recording apparatus forms printed images by discharging ink from its ink jet recording head 21 at given timing.

The other end of the tube 35, opposite to the end connected to the ink tank 34, is connected to the supply tube supporting portion 22 of the supply tube 23 arranged at the deep end of the cartridge case 33. Also, it is arranged that the circumference of the supply tube 23 is surrounded by a larger wall 36 than the supply tube 23. In this way, the ink cartridge fitting portion 27 and wall 36 are fitted together.

Also, for the cartridge case 33, a pair of guiding portions 29 are arranged up and down when observing the cartridge case on FIG. 3. On the ink cartridge 24 side, grooved guided portions 25 are arranged corresponding to the guiding portions 20, respectively.

In accordance with the present embodiment, the supply tube 23 is covered by the wall 36, and it cannot be touched by hand. Therefore, this structure does not allow any dust particles to adhere to the supply tube, and or there is no possibility of an excessive force is being exerted thereon.

Now, with reference to FIG. 3, description will be made of the process and method of positioning the ink cartridge 24 and supply tube 23.

The user inserts the guided portion 25 of the ink cartridge 24 into the guiding portion 29 of the cartridge case 33, and presses the ink cartridge 24 to the deep side of the cartridge case 33 along the guiding portion 29.

Then, the end of the ink cartridge fitting portion 27 reaches the pointed end of the supply tube 23. In other words, the fitting portion 27 of the ink cartridge and the wall 36 begin to engage with each other. At this juncture, since a tapered portion 30 is arranged for one end of the guiding portion 29 on the deep side of the cartridge case 33, the engagement between the guided portion 25 and guiding portion 29 tends to begin being released. Also, even in this state, the plug 26 is yet to reach the supply tube 23.

When the ink cartridge 24 is further pressed toward the deep side, the ink cartridge fitting portion 27 and wall 36 engage with each other. In this state, the engagement between the guided portion 25 and guiding portion 29 is completely released. Therefore, the ink cartridge 24 is not restricted rigidly by the guiding portion 29 on the deep side portion of the cartridge case 33.

Thereafter, when the ink cartridge 24 is further pressed, the plug 26 reaches the supply tube 23, and then, the supply tube 23 penetrates the plug 26 or the hole, if any, provided in the plug 26. Thus the installation of the ink cartridge 24 is completed.

Third Embodiment

The present embodiment is of such a structure as to implement a further reduction of the load given to the supply tube described in the second embodiment.

Figure 4:
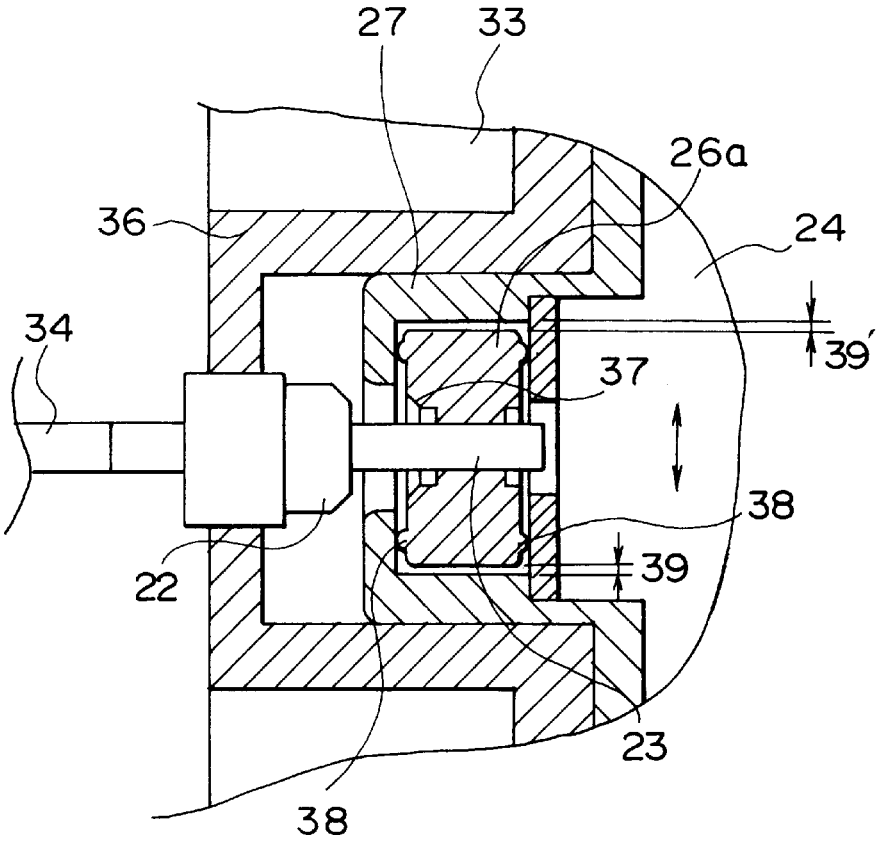
FIG. 4 is an enlarged section of the circumference of the supply tube of a third embodiment of the structure for positioning an ink cartridge of an ink jet recording apparatus in accordance with the present invention.

FIG. 4 is an enlarged section of the circumference of a supply tube in accordance with a third embodiment of the structure for positioning an ink cartridge of an ink jet recording apparatus of the present invention. In FIG. 4, the same reference marks are applied to the same elements as in FIG. 3. For the present embodiment, the description of any portions that are also in the second embodiment will be omitted.

In FIG. 4, protrusions 38 are formed on both faces of a plug 26*a* in order to provide a good seal and on the leading end side of the ink cartridge fitting portion 27, a slanted or beveled face 37 is formed for the prepared hole in the plug 26*a*. Also, the plug 26*a* is incorporated in the ink cartridge 24 with the provision of gaps 39 between the plug 26*a* and the adjacent walls 27 of the cartridge 24. As a result, it is easy for the plug to move in the direction indicated by arrows in FIG. 4.

As described above, since the plug 26*a* can easily move in the directions indicated by arrows even after it has been incorporated in the ink cartridge 24, the plug 26*a* can shift with respect to the supply tube 23 by the functions of the slanted faces 37 and gaps 39 during the process in which the ink cartridge fitting portion 27 and wall 36 are allowed to engage and to be inserted. As a result, no load is applied to the supply tube 23 and the prepared hole of the plug 26*a*, thus making it possible to perform positioning more accurately. Also, this structure has been found to maintain good operability.

Fourth Embodiment

Figure 5:
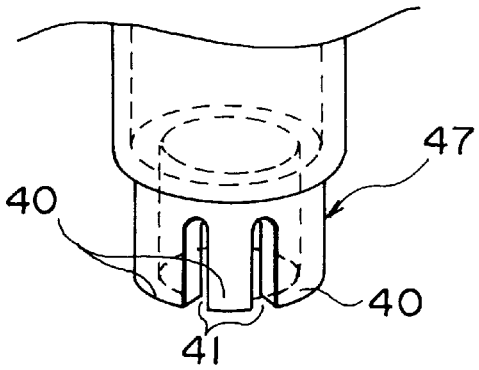
FIG. 5 is a perspective view which shows the fitting portion of an ink cartridge of a fourth embodiment of the structure for positioning an ink cartridge of an ink jet recording apparatus in accordance with the present invention.
Figure 6:
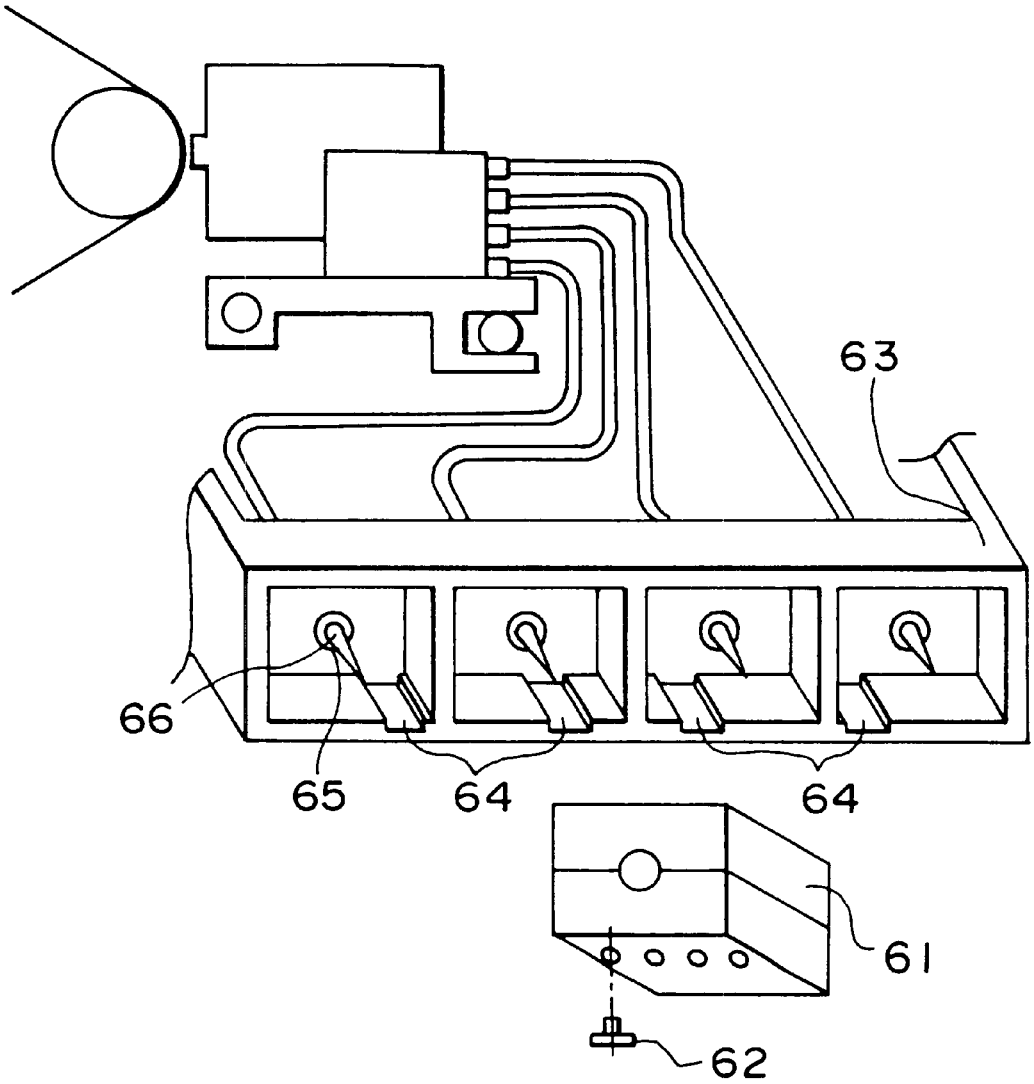
FIG. 6 PRIOR ART
FIG. 6 is a perspective view which schematically shows the structure for positioning an ink cartridge in accordance with the prior art.
Figure 7:
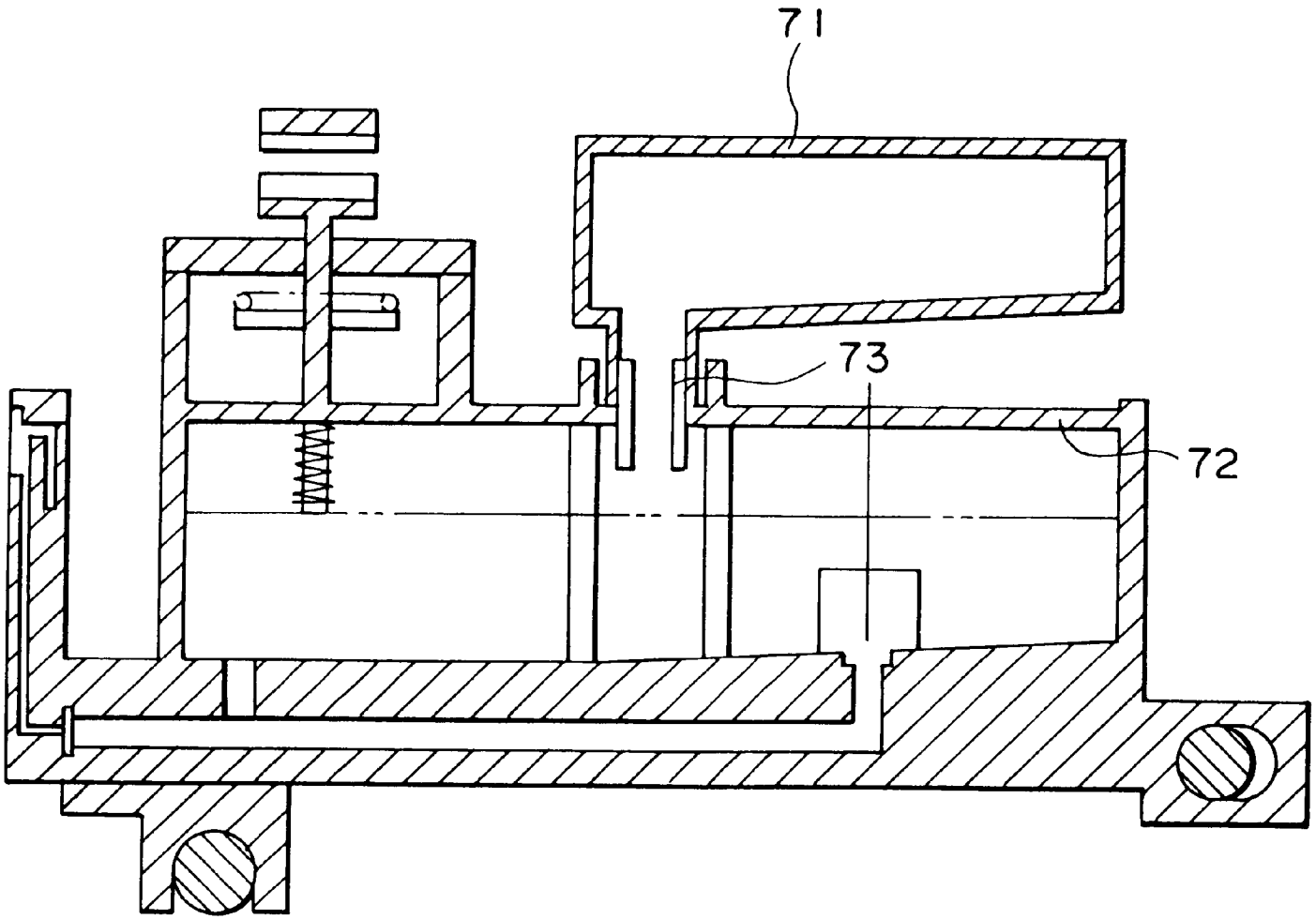
FIG. 7 PRIOR ART
FIG. 7 is a view which schematically shows another example of structure for positioning an ink cartridge in accordance with the prior art.

FIG. 5 is a view which shows an ink cartridge fitting portion 47 in accordance with a fourth embodiment of the structure for positioning an ink cartridge of an ink jet recording apparatus of the present invention.

The present embodiment, as shown in FIG. 5, has cut-out portions 41 are provided for the ink cartridge fitting portion 47 referred to in the first and second embodiments, and thus, elasticity is given to this portion as a fitting piece 40. With such structure, it is possible to implement a further reduction of the load on the supply tube supporting portion and the ink jet recording head described in the first and second embodiments.

Now, as each of the embodiments are structured as described above, it is possible to obtain the following effects:

(1) When an ink cartridge is being installed on a given housing member in order to connect the ink cartridge and ink jet recording head through a supply tube, the ink cartridge is guided by use of guiding means, and at the same time, the ink cartridge fitting portion, which is arranged in the vicinity of the plug to be used for sealing ink in the ink cartridge, is allowed to engage with the extruded supporting portion of the supply tube arranged for the given housing member or with the wall surrounding the extruded supply tube on the deep side of the given housing member. With the structure thus arranged, it is possible to position the supply tube and the plug or the prepared hole of the plug in high precision, while implementing the improvement of its operativity.

(2) Guiding means is structured to release the engagement between an ink cartridge and a given housing member, which has been made without any looseness until when the ink cartridge fitting portion and the supply tube supporting portion reach a location where these portions begin to engage with each other during the process in which the ink cartridge is installed. In this way, it is possible to minimize damage to the supply tube supporting portion even in a frequent attachment and detachment of the ink cartridge. Particularly, for the structure where the supply tube supporting portion is incorporated directly in an ink jet recording head, it is possible to minimize any adverse effects on the inner liquid path of the ink jet recording head and the slanted posture of facing plate of the ink jet recording head, hence obtaining clearly printed images reliably.

(3) An elastic stopper is provided for an ink cartridge, but the position where the elasticity of the stopper of the ink cartridge begins to act is set at a location after the engagement has been made between the ink cartridge fitting portion and the supply tube supporting portion. In this way, it is possible to enhance the operativity still more.

(4) Cut-out portions are provided for an ink cartridge fitting portion to provide it with elasticity, hence making it possible to reduce any load on the supply tube supporting portion and others.

What is claimed is:

1. A method for positioning an ink cartridge with respect to an ink cartridge housing member, the ink cartridge having an ink cartridge fitting portion and the ink cartridge housing member having an ink supply tube, an ink supply tube supporting portion, and an ink cartridge installation surface for mounting said ink cartridge thereon when said ink cartridge is housed in said cartridge housing member, and the ink cartridge housing member, further having a guide member and for said ink cartridge housing member to guide said ink cartridge by engaging therewith during guiding of said ink cartridge to said ink cartridge installation surface, thereby making engagement between said ink cartridge housing member and said ink cartridge, said guiding being performed, in an early stage followed by a terminating stage, the guide member comprising a first guiding member to engage with said ink cartridge at the early stage of guiding and a second guiding member whose engagement with said ink cartridge is released at least partly, at the terminating stage of guiding, wherein said guide member is so constructed as to maintain engagement with the ink cartridge until said ink supply tube is in contact with the fitting portion of the ink cartridge, the method comprising the steps of:

at the early stage of guiding, positioning said ink supply tube with respect to said ink cartridge fitting portion by guiding, with said first guiding member, said ink cartridge to obtain engagement between said ink cartridge housing member and said ink cartridge until the ink cartridge fitting portion and the ink supply tube supporting portion begin to engage with each other; and at the termination stage of guiding, completing the mounting of said ink cartridge on said ink cartridge housing member by engaging the ink cartridge by said second guiding member and by releasing at least partly the engagement between said second guiding member of said ink cartridge housing member and said ink cartridge after the ink cartridge fitting portion and the ink supply tube supporting portion engage with each other.

2. A method for positioning an ink cartridge according to claim 1, wherein, in said positioning step the engagement between said ink cartridge housing member and said ink cartridge is made without any looseness, and said ink cartridge is guided to position said ink supply tube with respect to the ink cartridge fitting portion with high precision.

3. A method for positioning an ink cartridge according to claim 1, wherein, in said completing step the engagement between said ink cartridge housing member and said ink cartridge is loosened, and said ink cartridge is guided to completely mount said ink cartridge on said ink cartridge housing member without causing restriction of movement of said ink cartridge by the ink supply tube supporting portion.

4. A method for positioning an ink cartridge according to claim 1, wherein said ink cartridge housing member is provided for an ink jet recording apparatus to perform recording by use of an ink jet head for discharging ink.

5. A method for positioning an ink cartridge according to claim 4, wherein the recording is performed in a recording area, and said ink cartridge housing member is arranged for a carriage traveling serially in the recording area and carrying said ink jet head.

6. A method for positioning an ink cartridge according to claim 4, wherein said ink jet head is provided with electrothermal transducing elements to generate energy for discharging the ink.

7. An ink jet recording apparatus to record on a recording medium by use of an ink jet head, the apparatus comprising:

an ink cartridge housing member for housing an ink cartridge, the ink cartridge storing ink for supply to said ink jet head and having a fitting portion;

an ink supply tube positioned for engagement with the fitting portion of said ink cartridge in order to supply the ink stored in said ink cartridge to said ink jet head;

a supply tube supporting portion located in said ink cartridge housing member in order to support said ink supply tube;

an ink cartridge installation surface, located on said ink cartridge housing member, for mounting said ink cartridge thereon when said ink cartridge is housed in said cartridge housing member; and a guide member located on said ink cartridge housing member and arranged for said ink cartridge housing member to guide said ink cartridge by engaging therewith during guiding of said ink cartridge to said ink cartridge installation surface, thereby making engagement between said ink cartridge housing member and said ink cartridge, said guiding being performed in an early stage followed by a terminating stage, said guide member comprising a first guiding member to engage with said ink cartridge at the early stage of guiding, arid a second guiding member whose engagement with said ink cartridge is released at least partly, at the terminating stage of guiding, wherein said guide member is so constructed as to maintain engagement with the ink cartridge until said ink supply tube is in contact with the fitting portion of the ink cartridge.

8. An ink jet recording apparatus according to claim 7, wherein said first guiding member guides said ink cartridge by making the engagement between said ink cartridge housing member and said ink cartridge without any looseness, in order to position said ink supply tube with respect to the fitting portion of said ink cartridge with high precision.

9. An ink jet recording apparatus according to claim 8, wherein said second guiding member guides said ink cartridge by loosening the engagement between said ink cartridge housing member and said ink cartridge, so that said ink cartridge is mounted in said ink cartridge housing member in a state where movement of the ink cartridge is not restricted by said supply tube supporting portion.

10. An ink jet recording apparatus according to claim 9, wherein said second guiding member is provided with a tapering configuration, so that engagement thereof with said ink cartridge is released in the terminating stage of guiding.

11. An ink jet recording apparatus according to claim 8, wherein the recording is performed in a recording area of the apparatus, and said ink cartridge housing member is arranged for a carriage traveling serially in the recording area and carrying said ink jet head.

12. An ink jet recording apparatus according to claim 8, wherein said ink jet head is provided with electrothermal transducing elements to generate energy for discharging the ink.

13. An ink cartridge for storing ink to be supplied to an ink jet head while the ink cartridge is housed in a cartridge housing member of an ink jet recording apparatus to record on a recording medium by use of said ink jet head, the cartridge housing member having an ink supply tube, a supply tube supporting portion to support said ink supply tube, and a cartridge installation surface, said ink cartridge comprising:

a fitting portion for engagement with said ink supply tube for supplying ink in said ink cartridge to said ink jet head; and a guided member, wherein the ink cartridge housing member has a guide member for guiding said ink cartridge by engaging with said guided member during guiding of said ink cartridge to said cartridge installation surface, thereby making engagement between said ink cartridge housing member and said ink cartridge, said guiding being performed in an early stage followed by a terminating stage, said guided member being constructed to engage with the guide member at the early stage of guiding and to release at least partly from engagement with the guide member at the terminating stage of guiding, such that engagement between said guided member and the guide member is maintained at least until said fitting portion is in contact with the ink supply tube of the cartridge housing member.

14. An ink cartridge according to claim 13, wherein said guide member comprises a first guiding member, and wherein said first guiding member guides said ink cartridge by making the engagement between said ink cartridge housing member and said ink cartridge without any looseness, in order to position said ink supply tube with respect to the fitting portion of said ink cartridge with high precision.

15. An ink cartridge according to claim 13, wherein said guide member comprises a first guiding member and a second guiding member, and wherein said second guiding member guides said ink cartridge by loosening the engagement between said ink cartridge housing member and said ink cartridge, go that said ink cartridge is mounted in said ink cartridge housing member in a state where movement of the ink cartridge is not restricted by said supply tube supporting portion.

16. An ink cartridge according to claim 13, wherein said guiding member comprises a first guiding member and a second guiding member, and wherein said second guiding member is provided with a tapering configuration, so that engagement thereof with said ink cartridge is released in the terminating stage of guiding.

17. An ink cartridge according to claim 13, wherein the recording is performed in a recording area of the ink jet recording apparatus, and said ink cartridge housing member is arranged for a carriage traveling serially in the recording area and carrying said ink jet head.

18. An ink cartridge according to claim 13, wherein said ink jet head is provided with electrothermal transducing elements to generate energy for discharging the ink.

* * * * *

UNITED STATES PATENT AND TRADEMARK OFFICE

CERTIFICATE OF CORRECTION

PATENT NO. : 6,022,103
DATED : February 8, 2000
INVENTOR(S) : Sanko Yamaguchi

It is certified that error appears in the above-identified patent and that said Letters Patent is hereby corrected as shown below:

Column 5,
Line 35, change "any )." to -- any). --, and change "FIG. 1" to -- FIG. 1A --.

Column 8,
Line 44, change "member and for said ink cartridge housing member" to -- member arranged --;
Line 50, change "member to" to -- portion --;
Line 52, change "member" to -- portion --; and
Line 60, change "member" to -- portion --.

Column 9,
Line 2, change "member" to -- portion --;
Line 3, change "member" to -- portion --;
Line 52, delete "for said ink cartridge housing";
Line 60, change "member" to -- portion --;
Line 61, change "arid" to -- and --; and
Line 62, change "member" to -- portion --.

Column 10,
Line 2, change "member" to -- portion --;
Line 8, change "member" to -- portion --;
Line 15, change "member" to -- portion --;
Line 40, delete "ink";
Line 56, change "member" to -- portion --;
Line 57, change "member" to -- portion --;
Line 64, change "member" to -- portion --;
Line 65, change "member" to -- portion --;
Line 66, change "member" to -- portion --;
Line 67, delete "ink".

Column 11,
Line 2, delete "ink";
Line 6, change "member" to -- portion --;
Line 7, change "member," to -- portion --;
Line 8, change "member" to -- portion --;

UNITED STATES PATENT AND TRADEMARK OFFICE

CERTIFICATE OF CORRECTION

PATENT NO. : 6,022,103
DATED : February 8, 2000
INVENTOR(S) : Sanko Yamaguchi

It is certified that error appears in the above-identified patent and that said Letters Patent is hereby corrected as shown below:

Column 12,
Line 3, delete "ink"; and
at the end of Column 12, insert Claims 19 to 36, as follows:

19. A method for positioning an ink cartridge with respect to an ink cartridge housing member, the ink cartridge having an ink cartridge fitting portion and the ink cartridge housing member having an ink supply tube, an ink supply tube supporting portion, a guided portion, and an ink cartridge installation surface for mounting said ink cartridge cartridge thereon when said ink cartridge is housed in said cartridge housing member, and the ink cartridge further having a guide member arranged to engage with said guided portion so as to guide said ink cartridge during guiding of said ink cartridge to said ink cartridge installation surface, thereby making engagement between said ink cartridge housing member and said ink cartridge, said guiding being performed in an early stage followed by a terminating stage, the guide member comprising a first guiding portion to engage with said ink cartridge housing member at the early stage of guiding, and a second guiding portion whose engagement with said ink cartridge housing member is released at least partly, at the terminating stage of guiding, wherein said guide member is so constructed as to maintain engagement with the ink cartridge housing member until said ink tube is in contact with the fitting portion of the ink cartridge, the method comprising the steps of:

at the early stage of guiding, positioning said ink supply tube with respect to said ink cartridge fitting portion by guiding, with said first guiding portion, said ink cartridge to obtain engagement between said ink cartridge housing member and said ink cartridge until the ink cartridge fitting portion and the ink supply tube supporting portion begin to engage with each other; and at the terminiating stage of guiding, completing the mounting of said ink cartridge on said ink cartridge housing member by engaging the ink cartridge by said second guiding portion and by releasing at least partly the engagement between said second guiding portion of said ink cartridge housing member and said ink cartridge after the ink cartridge fitting portion and the ink supply tube supporting portion engage with each other.

It is certified that error appears in the above-identified patent and that said Letters Patent is hereby corrected as shown below:

20. A method for positioning an ink cartridge according to Claim 19, wherein, in said positioning step the engagement between said ink cartridge housing member and said ink cartridge is made without any looseness, and said ink cartridge is guided to position said ink supply tube with respect to the ink cartridge fitting portion with high precision.

21. A method for positioning an ink cartridge according to Claim 19, wherein, in said completing step the engagement between said ink cartridge housing member and said ink cartridge is loosened, and said ink cartridge is guided to completely mount said ink cartridge on said ink cartridge housing member without causing restriciton of movement of said ink cartridge by the ink supply tube supporting portion.

22. A method for positioning an ink cartridge according to Claim 19, wherein said ink cartridge housing member is provided for an ink jet recording apparatus to perform recording by use of an ink jet head for discharging ink.

23. A method for positioning an ink cartridge according to Claim 22, wherein the recording is performed in a recording area, and said ink cartridge housing member is arranged for a carriage traveling serially in the recording area and carrying said ink jet head.

24. A method for positioning an ink cartridge according to Claim 22, wherein said ink jet head is provided with electrothermal transducing elements to generate energy for discharging the ink.

25. An ink jet recording apparatus to record on a recording medium by use of an ink jet head, the apparatus comprising:

an ink cartridge housing member for housing an ink cartridge, the ink cartridge storing ink for supply to said ink jet head and having a fitting portion;

an ink supply tube positioned for engagement with the fitting portion of said ink cartridge in order to supply the ink stored in said ink cartridge to said ink jet head;

a supply tube supporting portion located in said ink cartridge housing member in order to support said ink supply tube;

It is certified that error appears in the above-identified patent and that said Letters Patent is hereby corrected as shown below:

an ink cartridge installation surface, located on said ink cartridge housing member, for mounting said ink cartridge thereon when said ink cartridge is housed in said cartridge housing member; and a guide member located on said ink cartridge and arranged to engage with a guided portion on said ink cartridge housing member so as to guide said ink cartridge during guiding of said ink cartridge to said ink cartridge installation surface, thereby making engagement between said ink cartridge housing member and said ink cartridge, said guiding being performed in an early stage followed by a terminating stage, said guide member comprising a first guiding portion to engage with said ink cartridge housing member at the early stage of guiding, and a second guiding member whose engagement with said ink cartridge housing member is released at least partly, at the terminating stage of guiding, wherein said guide member is so constructed as to maintain engagement with the ink cartridge housing member until said ink supply tube is in contact with the fitting portion of the ink cartridge.

26. An ink jet recording apparatus according to Claim 25, wherein said first guiding portion guides said ink cartridge by making the engagement between said ink cartridge housing member and said ink cartridge without any looseness, in order to position said ink supply tube with respect to the fitting portion of said ink cartridge with high precision.

27. An ink jet recording apparatus according to Claim 26, wherein said second guiding portion guides said ink cartridge by loosening the engagement between said ink cartridge housing member and said ink cartridge, so that said ink cartridge is mounted in said ink cartridge housing member in a state where movement of the ink cartridge is not restricted by said supply tube supporting portion.

28. An ink jet recording apparatus according to Claim 27, wherein said second guiding portion is provided with a tapering configuration, so that engagement thereof with said ink cartridge housing member is released in the terminating stage of guiding.

29. An ink jet recording apparatus according to Claim 26, wherein the recording is performed in a recording area of the apparatus, and said ink cartridge housing member is arranged for a carriage traveling serially in the recording area and carrying said ink jet head.

It is certified that error appears in the above-identified patent and that said Letters Patent is hereby corrected as shown below:

30. An ink jet recording apparatus according to Claim 26, wherein said ink jet head is provided with electrothermal transducing elements to generate energy for discharging the ink.

31. An ink cartridge for storing ink to be supplied to an ink jet head while the ink cartridge is housed in a cartridge housing member of an ink jet recording apparatus to record on a recording medium by use of said ink jet head, the cartridge housing member having an ink supply tube, a supply tube supporting portion to support said ink supply tube, a guided member, and a cartridge installation surface, said ink cartridge comprising:

a fitting portion for engagement with said ink supply tube for supplying ink in said ink cartridge to said ink jet head; and a guide member for engaging with said guided member of said cartridge housing member and for guiding said ink cartridge during guiding of said ink cartridge to said cartridge installation surface, thereby making engagement between said ink cartridge housing member and said ink cartridge, said guiding being performed in an early stage followed by a terminating stage, said guided member being constructed to engage with the guide member at the early stage of guiding and and to release at least partly from engagement with the guide member at the terminating stage of guiding, such that engagement between said guided member and the guide member is maintained at least until said fitting portion is in contact with the ink supply tube of the cartridge housing member.

32. An ink cartridge according to Claim 31, wherein said guide member comprises a first guiding portion, and wherein said first guiding portion guides said ink cartridge by making the engagement between said cartridge housing member and said ink cartridge without any looseness, in order to position said ink supply tube with respect to the fitting portion of said ink cartridge with high precision.

33. An ink cartridge according Claim 31, wherein said guide member comprises a first guiding portion and a second guiding portion, and wherein said second guiding portion guides said ink cartridge by loosening the engagement between said cartridge housing member and said ink cartridge, so that said ink cartridge is mounted in said cartridge housing member in a state where movement of the ink cartridge is not restricted by said supply tube supporting portion.

UNITED STATES PATENT AND TRADEMARK OFFICE

CERTIFICATE OF CORRECTION

PATENT NO. : 6,022,103
DATED : February 8, 2000
INVENTOR(S) : Sanko Yamaguchi

It is certified that error appears in the above-identified patent and that said Letters Patent is hereby corrected as shown below:

34. An ink cartridge according to Claim 31, wherein said guide member comprises a first guiding portion and a second guiding portion, and wherein said second guiding portion is provided with a tapering configuration, so that engagement thereof with said cartridge housing member is released in the terminating stage of guiding.

35. An ink cartridge according to Claim 31, wherein the recording is performed in a recording area of the ink jet recording apparatus, and said cartridge housing member is arranged for a carriage traveling serially in the recording area and carrying said ink jet head.

36. An ink cartridge according to Claim 31, wherein said ink jet head is provided with electrothermal transducing elements to generate energy for discharging the ink. --

Signed and Sealed this

Fourteenth Day of August, 2001

Nicholas P. Godici

*Attest:*

*Attesting Officer*

NICHOLAS P. GODICI
*Acting Director of the United States Patent and Trademark Office*